United States Patent [19]

Huang et al.

[11] Patent Number: 5,042,233

[45] Date of Patent: Aug. 27, 1991

[54] APPARATUS AND METHOD FOR UNCLOSING AND ENCLOSING FLAPS OF A PACKAGE CARTON DURING AN AUTOMATIC PACKING PROCESS

[75] Inventors: Gordon Huang; Gang-Shyr Guan; Wen-Chau Wang; Shun-Shang Kao; Shih-Hen Shyu; Fu-Ching Tung; Jin-Guan Liu, all of Hsinchu, Taiwan

[73] Assignee: Industrial Technology Research Institute, Taiwan, Taiwan

[21] Appl. No.: 548,371

[22] Filed: Jul. 5, 1990

[51] Int. Cl.[5] ..... B65B 7/20; B65B 43/26

[52] U.S. Cl. ..... 53/468; 53/491; 53/564; 53/242; 53/377.2; 53/382.3

[58] Field of Search ..... 53/242, 249, 374, 381 R, 53/382, 458, 468, 491, 564, 579, 377.2, 382.3; 493/163, 183

[56] References Cited

U.S. PATENT DOCUMENTS

| | | | |
|---|---|---|---|
| 2,734,323 | 2/1956 | Laub, III | 53/491 X |
| 3,350,836 | 11/1967 | Dillon et al. | 53/242 X |
| 3,389,645 | 6/1968 | Winters et al. | 493/183 X |
| 3,673,764 | 7/1972 | Bell et al. | 53/374 |
| 3,808,770 | 5/1974 | Berney | 53/374 X |
| 3,842,571 | 10/1974 | Focke et al. | 53/564 |
| 3,846,962 | 11/1974 | Rossi | 53/374 |
| 4,565,050 | 1/1986 | Norris | 53/491 |

FOREIGN PATENT DOCUMENTS 2617080 10/1977 Fed. Rep. of Germany .... 53/381 R

*Primary Examiner*—John Sipos

[57] ABSTRACT

A method and apparatus for unclosing and enclosing the flaps of a package carton, so that cartons can be transported along the transportation path without shifting backward or shifting away from the transportation path. The method consists of (a) disposing a package carton on a first transportation slab with the opening of the package carton facing downward; (b) continuously guiding the package carton in the longitudinal direction of the first transportation slab; (c) folding the leading first flap in an upward and forward direction, and guiding the leading first flap to lap on a second transportation slab, then urging the lagging first flap to lap on the second transportation slab; (d) folding the second pair of flaps to trap the second transportation slab between the opening of the package carton and the second pair of flaps; (e) guiding the second pair of flaps to skip from underneath the second transportation slab and to lap on a third transportation slab; (f) folding the leading first slap in a downward and backward direction to trap the third transportation slab between the opening of the package carton and the leading first flap, and guiding the leading first flap to lap on a fourth transportation slab; (g) folding the lagging first flap in a downward and forward direction to trap the fourth transportation slab between the opening of the package carton and the lagging first flap; and (h) guiding the lagging first flap to lap on a fifth transportation slab.

20 Claims, 9 Drawing Sheets

FIG. 1a
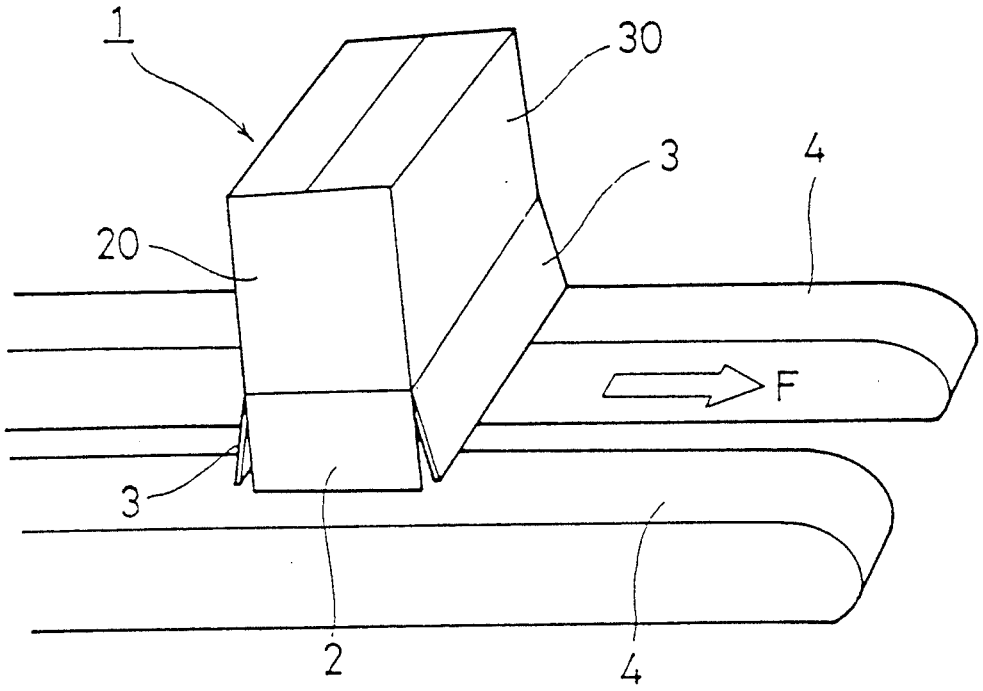
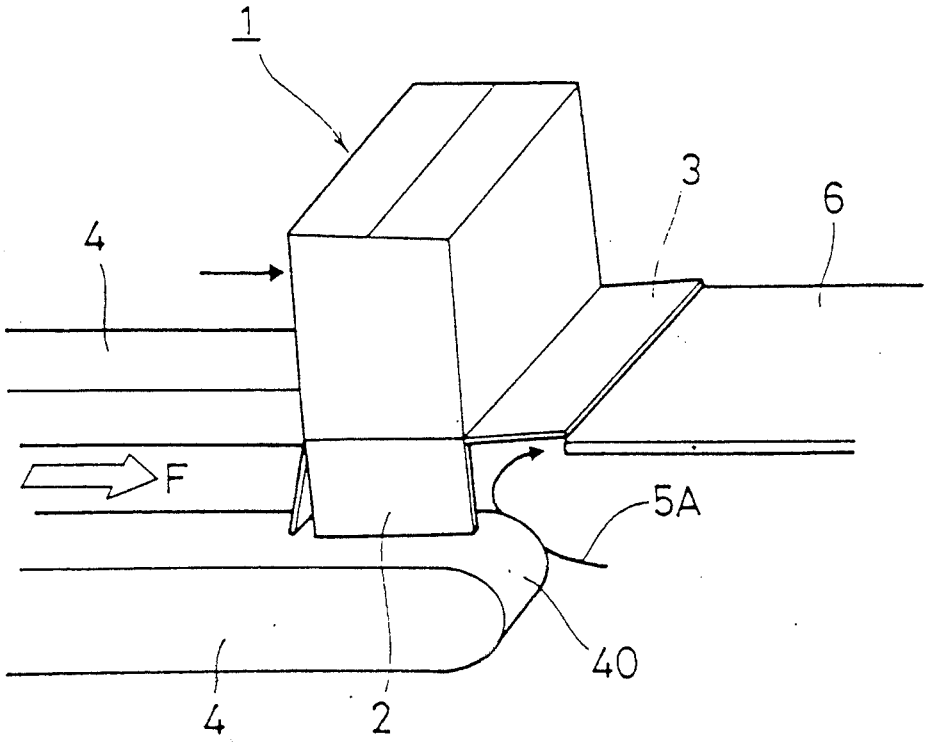
FIG. 1b

FIG.1c
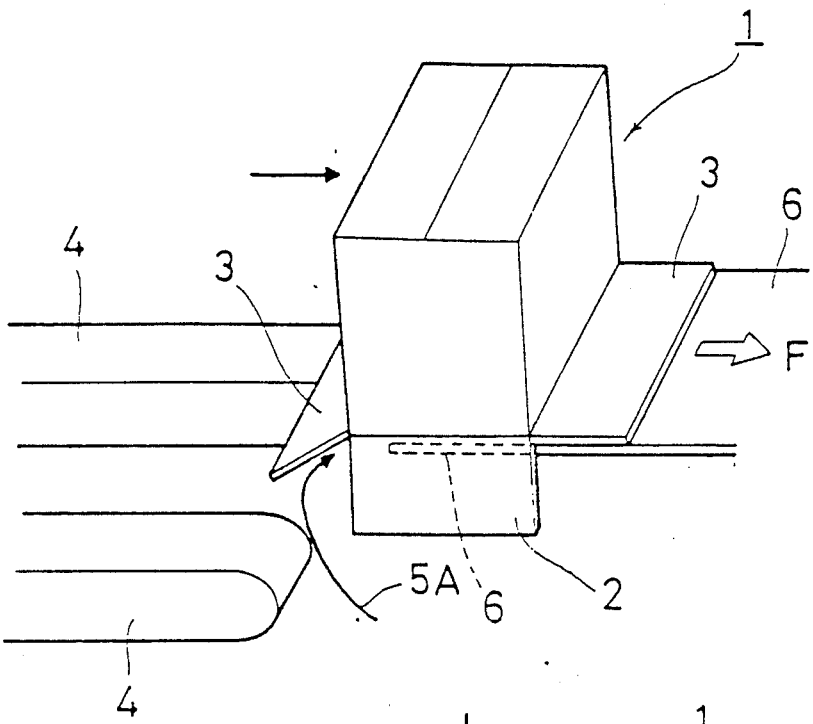
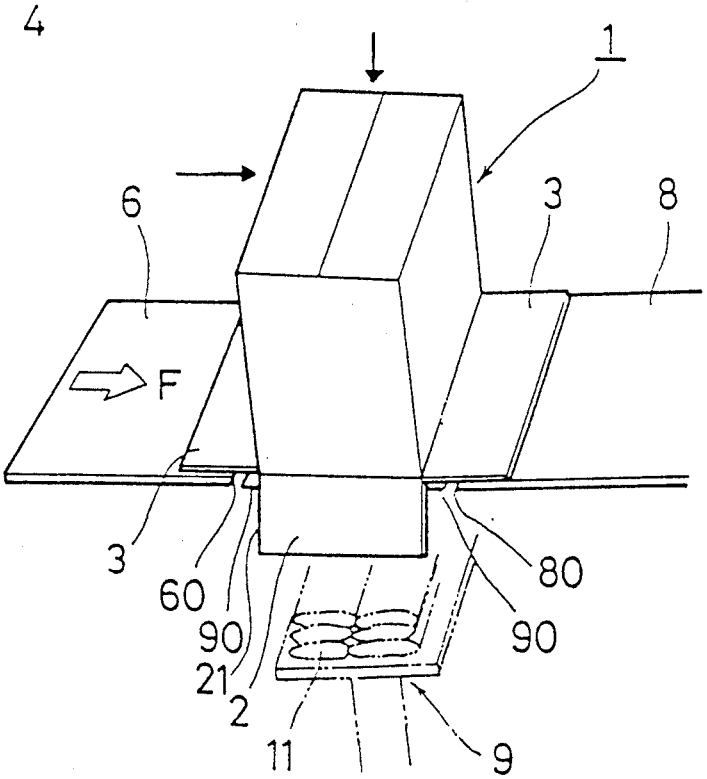
FIG.1d

FIG.1e
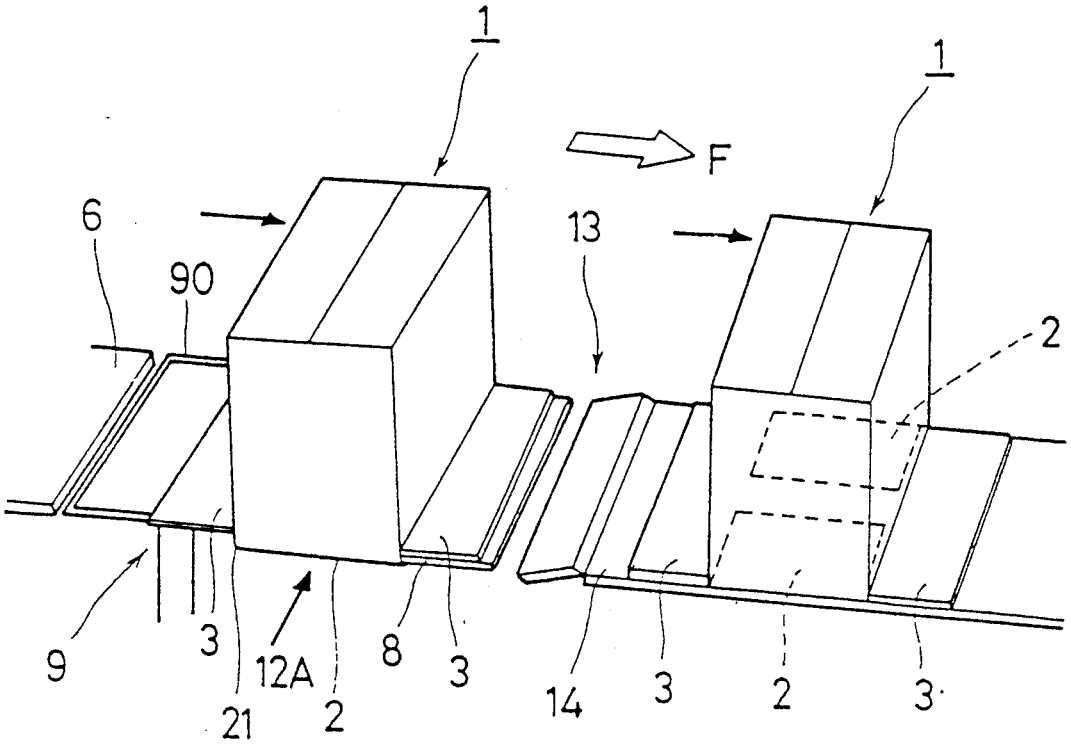
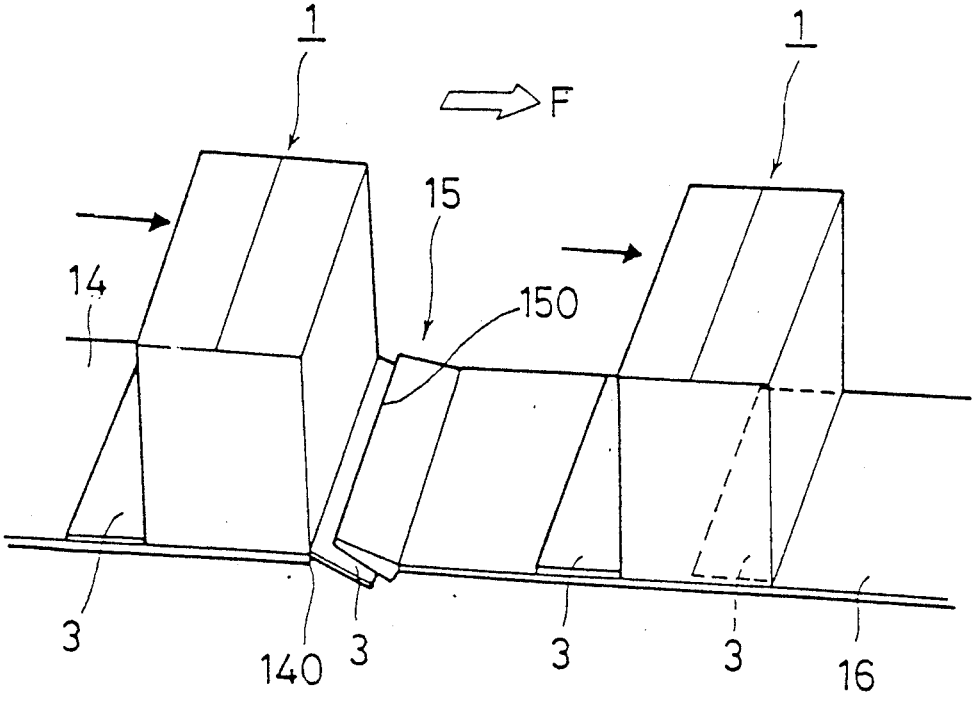
FIG.1f

APPARATUS AND METHOD FOR UNCLOSING AND ENCLOSING FLAPS OF A PACKAGE CARTON DURING AN AUTOMATIC PACKING PROCESS

BACKGROUND OF THE INVENTION

The present invention relates generally to a method for unclosing and enclosing the flaps of a package carton during an automatic packing process and the apparatus therefor, and particularly to an apparatus for unclosing and enclosing the flaps of a package carton whose opening is disposed downward during an automatic packing process, so articles can be stowed into the package carton through the opening of the package carton.

It is known that materials packed in poly bags or rigid packages can be stowed into cardboard boxes or cartons by disposing the openings of the cardboard boxes or cartons downward and pushing upward bags or packages, which are piled in lots, from under the openings into the cardboard boxes or the cartons. Thus, bags piled in lots are kept in a tidy way during stow operation.

During an automatic packing process, dust flaps and tuck flaps of a carton are unclosed, so that bags can be stowed upward through the opening of the carton, and after the carton has been filled up, the dust flaps are folded, then the tuck flaps are folded to enclose the carton. Conventionally, the flaps of the carton are folded by shifting the carton along transportation path forward and backward, or shifting the carton to and fro in the directions perpendicular to the transportation path (leftward and rightward). In other words, in order to enclose the flaps, the carton has to be shifted backward or to be shifted away from its transportation path. Thus, the transportation of the cartons will be hindered during folding of the flaps of the carton, and the efficiency of the automatic packing process is low.

SUMMARY OF THE INVENTION

The primary object of the present invention is to provide a method for unclosing and enclosing the flaps of a package carton during an automatic packing process and the apparatus therefor, so that cartons can be transported along the transportation path smoothly and swiftly without shifting backward or shifting away from the transportation path.

In accordance with the present invention, an apparatus for unclosing and enclosing flaps of a package carton during an automatic packing process, the package carton is provided with one pair of first flaps and one pair of second flaps disposed perpendicular to each other and connected to the opening of the package carton, which apparatus comprises: a first dispose device for disposing an empty package carton on a first transportation slab in such a way that the opening of the package carton faces downward and the two pairs of flaps extend downward without restraint from the opening of the carton, and the pair of second flaps is parallel with the first transportation slab; a first guide device for guiding the package carton to move continuously in the longitudinal direction of the first transportation slab; a first fold device for folding the leading first flap in an upward and forward direction, and guiding the leading first flap to lap on a second transportation slab disposed adjacent to the end portion of the first transportation slab, then urging the lagging first flap to lap on the second transportation slab, so as to let the second pair of flaps extend downward without any restraints during the movement of the package carton; a second fold device for folding the second pair of flaps to trap the second transportation slab between the opening of the package carton and the second pair of flaps during the movement of the package carton; a second guide device for guiding the second pair of flaps to skip from underneath the second transportation slab and to lap on a third transportation slab disposed adjacent to the end portion of the second transportation slab during the movement of the package carton; a third fold device for folding the leading first flap in a downward and backward direction to trap the third transportation slab between the opening of the package carton and the leading first flap, and guiding the leading first flap to lap on a fourth transportation slab closely spaced from the end portion of the third transportation slab during the movement of the package carton; a fourth fold device for folding the lagging first flap in a downward and forward direction to trap the fourth transportation slab between the opening of the package carton and the lagging first flap; and a third guide device for guiding, in the direction perpendicular to the longitudinal direction of the fourth transportation slab, the lagging first flap to lap on a fifth transportation slab disposed adjacent to the fourth transportation slab during the movement of the package carton.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention can be more fully understood by reference to the following description and accompanying drawings, which form an integral part of this application and which are given by way of illustration only, and thus are not limitative of the present invention, and wherein:

FIG. 1*a* to FIG. 1*g* are perspective views showing the consecutive steps of unclosing and enclosing the flaps of cartons according to this invention;

DETAILED DESCRIPTION OF THE PREFERRED EMBODIMENT

Figure 2:
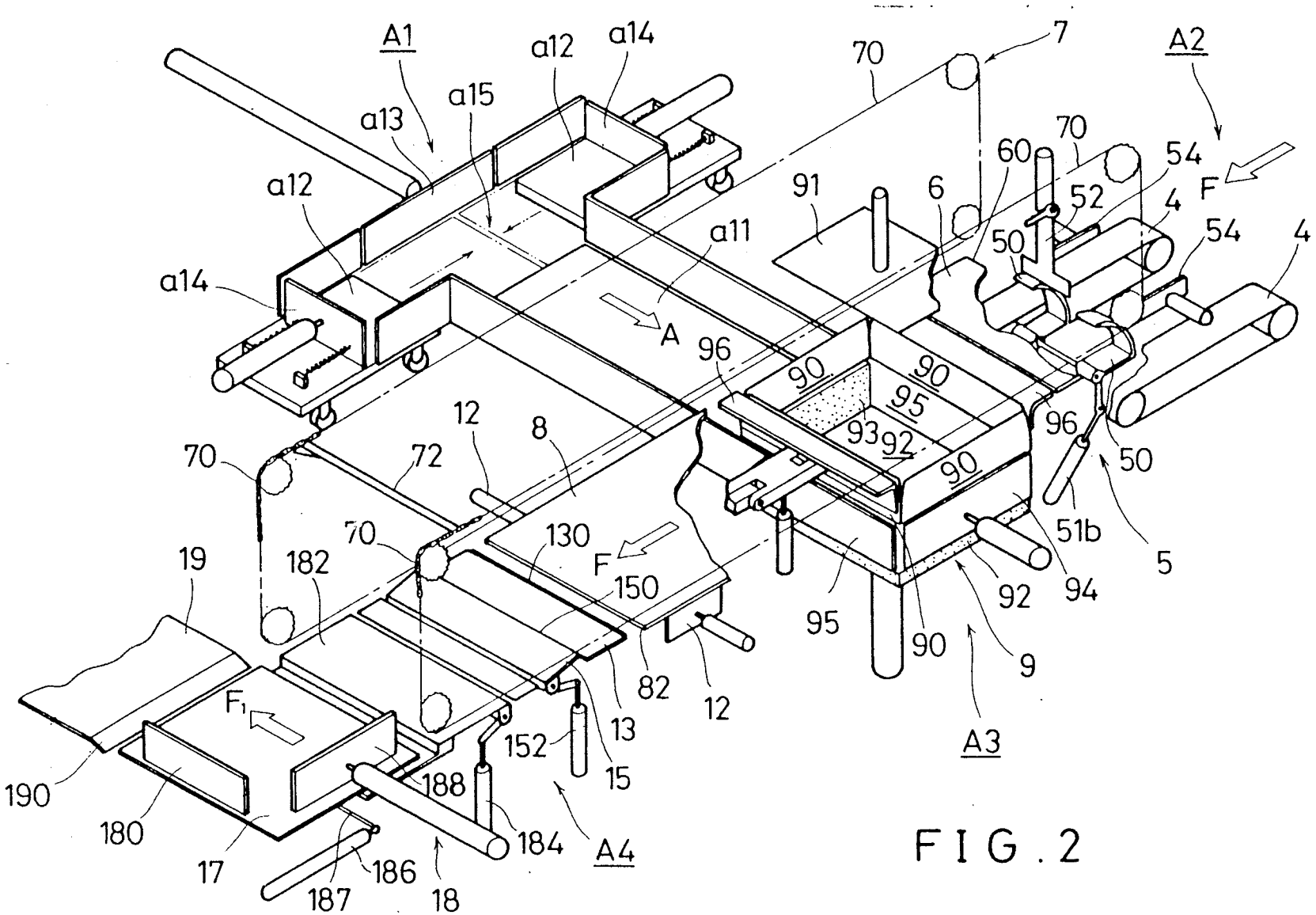
FIG. 2 is a perspective view of a preferred embodiment of this invention, showing the apparatus used for unclosing and enclosing the flaps of cartons.

As shown in FIG. 2, the apparatus of this invention comprises an article supply section A1, a carton supply section A2, a stow section A3, and a tuck flap enclose section A4.

The article supply section A1 comprises an article standby plate a11, one pair of shift plates a12 for shifting articles piled thereon toward each other, a push pad a13 for pushing articles piled on the shift plates a12 onto the article standby plate a11, one pair of check plates a14 for dropping imperfect articles, and an expel opening a15 for expelling imperfect articles. The articles piled on the shift plates a12 are shifted toward each other by the shift plates a12 to align with each other, then the push pad a13 pushes the aligned articles onto the article standby plate a11. It should be noted that if a sensor (not shown) detects at least one of the articles piled on the shift plates a12 is damaged, the check plates a14 will be actuated to drop the damaged articles through the expel opening a15.

Figure 3:
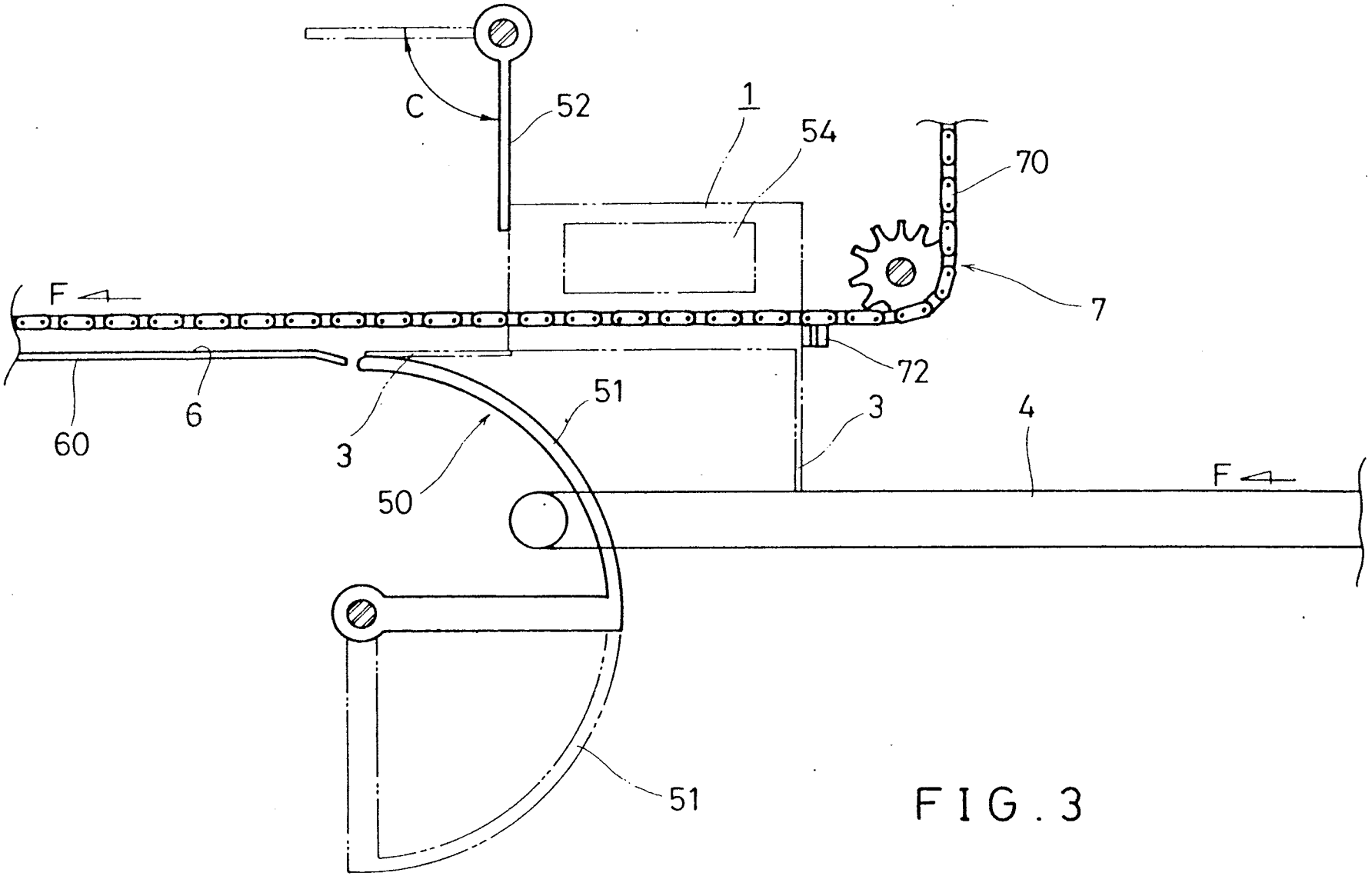
FIG. 3 is a side view showing the carton supply section of the apparatus shown in FIG. 2.

The carton supply section A2 is composed of one pair of conveyer belts (first transportation means) 4; one flap unclose device 5 comprising two tuck flap enclose plates 50, two stoppers 52, and two carton hold plates 54; a first transportation slab 6 having a first transportation surface 60; a guide device 7 comprising two chain conveyers 70 (second transportation means), a plurality of guide bars 72 disposed between the chain conveyers 70. As shown in FIG. 3, carton 1 being transported in the direction of the arrow F will be stopped temporarily by the stoppers 52 and will be held by the carton hold plates 54, then the circular plates 51 of the tuck flap enclose plates 50 will be raised from standby position shown in dotted lines to an elevated position so as to come close to the first transportation slab 6, and the leading tuck flap 3 will be conducted to raise to a horizontal position capable of lapping on the first transportation slab 6. At the same time, the stopper 52 is raised, and the chain conveyers 70 begin to move again and the guide bar 72 behind the carton 1 will guide the carton 1 to move toward the first transportation slab 6. When the carton 1 is guided to move forward, the leading tuck flap 3 will lap on the first transportation surface 60, and the lagging tuck flap 3 will eventually be conducted to be unclosed and lap on the first transportation surface 60 by the circular plates 51 of the tuck flap enclose plates 50.

Figure 4:
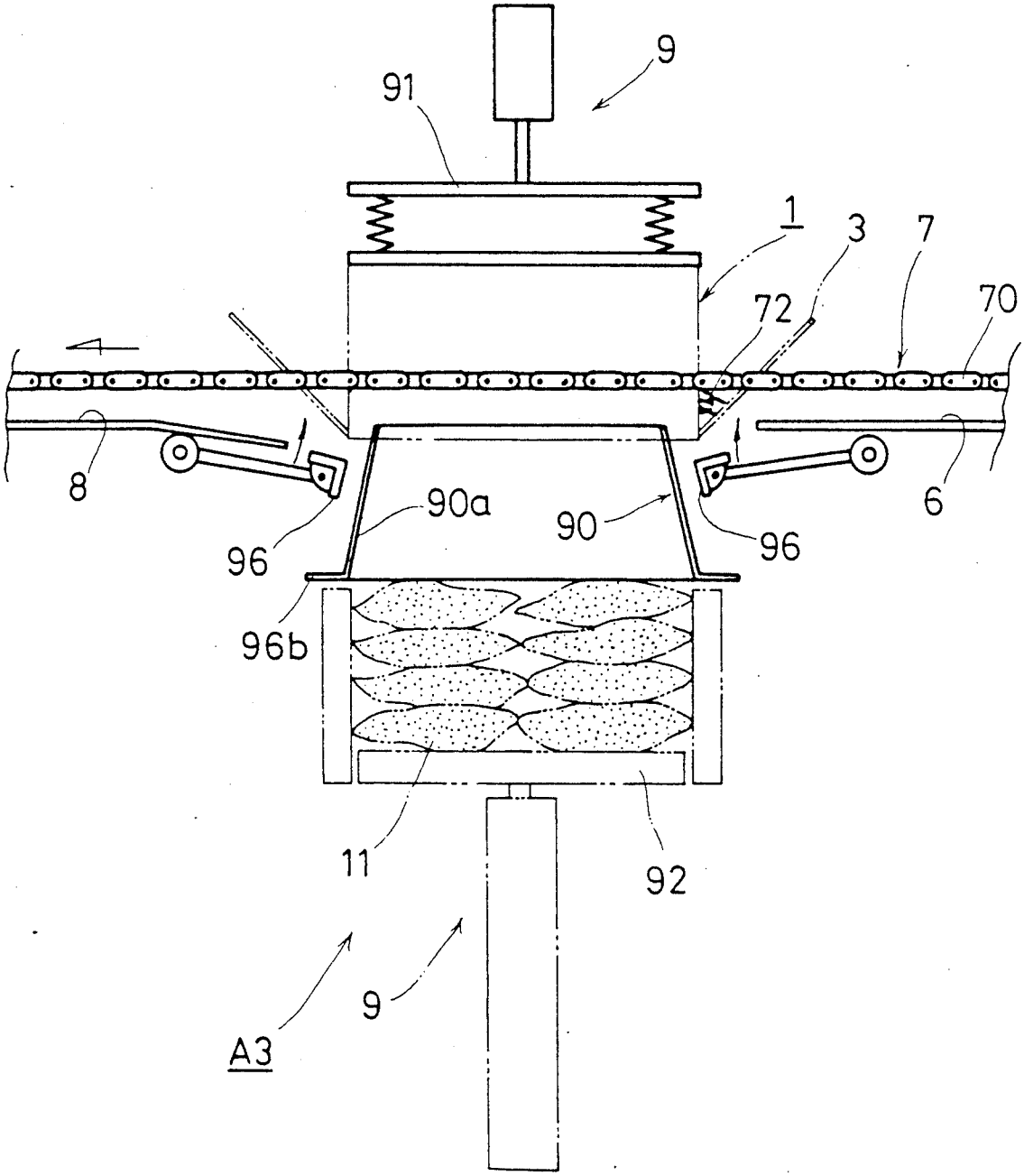
FIG. 4 is a side view showing the stow section of the apparatus shown in FIG. 2.

The stow section A3 is disposed between the first transportation slab 6 and the second transportation slab 8. As shown in FIG. 2 and FIG. 4, the stow section A3 comprises a guide frame 90, a push pad 91, and a stow device 9. The stow device 9 is composed of a stow plate 92 which is flushed with the article standby plate a11 when in standby states; a partition plate 93 which will be lowered to allow piled articles 11 to be pushed onto the stow plate 92; an adjust plate 94 for lining up the piled articles 11 pushed onto the stow plate 92; one pair of guide plates 95; and one pair of strip plates 96 for stripping the carton 1 from the guide frame 90 after the piled articles have stowed from the underneath into the carton 1. The guide frame 90 is made of elastic materials. When the carton 1, with flaps unclosed, is pushed downward by the push pad 91, the carton 1 will cover the guide frame 90 and be secured thereon, thus the carton 1 will be held fixedly during the stowing of the piled articles 11.

The tuck flap enclose section A4 comprises a flap enclose device 12, a skip device 13, a third transportation slab 14 (shown only in FIG. 1*e*), a leading flap enclose device 15, a fifth transportation slab 17, a lagging tuck flap enclose device 18, a push pad 188, and a skip device 190. The flap enclose device 12 will fold the dust flaps 2 when the rear end edges 21 of the dust flaps 2 have just passed over the front end portion of the stow device 9 (see FIG. 1*e*). The rear end portion 130 of the skip device 13 is disposed adjacent to and below the front end portion 82 of the second transportation slab 8 so that when the carton 1 is urged by the guide bar 72, the dust flaps 2 of the carton 1 will eventually be guided by the skip device 13 to move from beneath the second transportation slab 8 toward the third transportation slab 14 and lap thereon. It should be noted that the third transportation slab 14 can be omitted to cut the transportation path short. The rear end edge 150 of the leading flap enclose device 15 is firstly raised above the upper surface of the skip device 13 so that the leading end edge of the leading tuck flap 3 will insert into the space formed underneath the end edge 150 when the carton 1 is guided to a place where the leading end edge of the leading tuck flap 3 approaches the front end portion of the skip device 13. Then the end edge 150 of the leading flap enclose device 15 is lowered to fold back the leading tuck flap 3.

The fifth transportation slab 17 is disposed at the end of the transportatation path of the carton 1 guided by the guide bar 72.

The lagging tuck flap enclose device 18 comprises a stopper 180 for stopping the forward movement of the carton 1 and adjusting the position of the carton 1 on the fifth transportation slab 17; a fold plate 182 for folding forward the lagging tuck flap 3; a fold plate drive device 184 for driving the fold plate 182 to swing downward and upward to fold the lagging tuck flap 3; and a hook 186 for urging the lagging tuck flap 3 toward the bottom of the fifth transportation slab 17 to ensure that the fold plate 182 is capable of pushing the lagging tuck flap 3 upward.

Figure 5A:
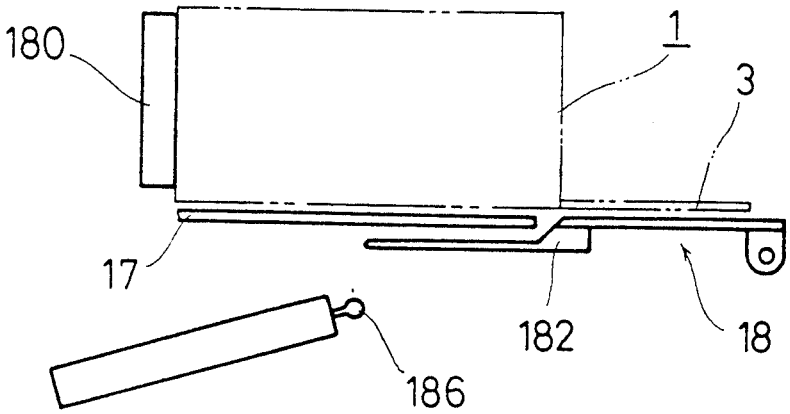
FIG. 5*a* to FIG. 5*c* are simplified diagrams showing the consecutive steps of enclosing a lagging tuck flap of a carton.
Figure 5B:
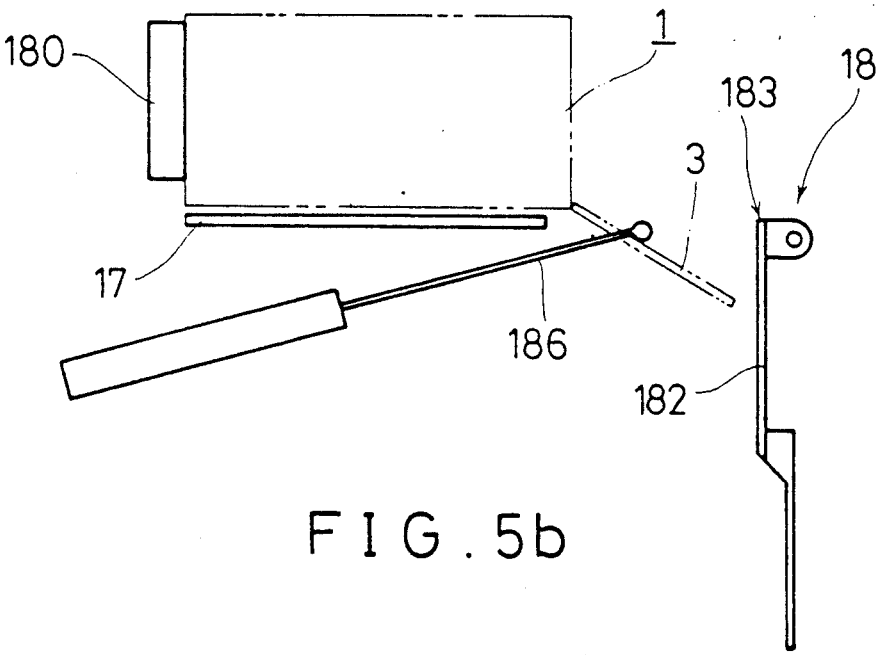
Figure 5C:
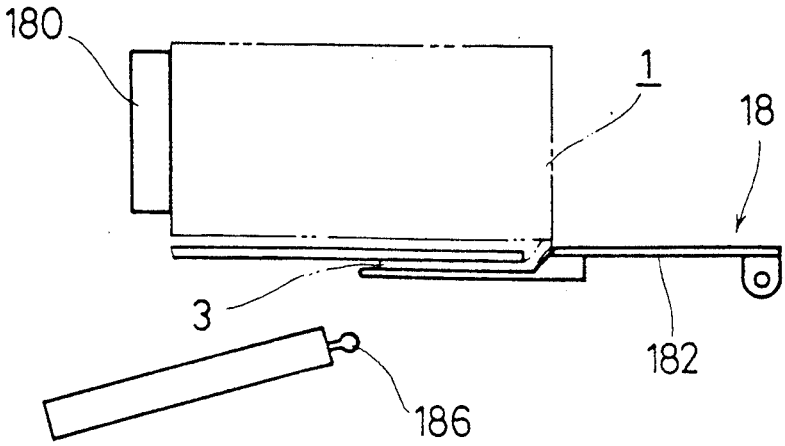

The following is a description of the operations of the hook 186 and the fold plate 182. As shown in FIG. 5*a*, when the carton 1 contacts the stopper 180 (see FIG. 5*a*), a limit switch (not shown) will be triggered, then the fold plate 182 will be driven to swing downward to let the end portion of the lagging tuck flap 3 drop down by its own gravity. After this, the hook 186 will extend to a maximum extension and withdraw backward to urge the lagging tuck flap 3 toward the bottom of the fifth transportation slab 17 (see FIG. 5*b*), then the fold plate 182 will be driven to swing upward and press the lagging tuck flap 3 onto the bottom of the fifth transportation slab 17. Under this circumstance, the fifth transportation slab 17 will be trapped between the dust flaps 2 and the lagging tuck flap 3 (see FIG. 5*c*). After the lagging tuck flap 3 has been folded, the carton 1 is pushed by a push pad 188 (see FIG. 2) in the direction F1, thus the carton 1 will be urged to move in the direction F1, and the lagging tuck flap 3 will eventually be guided by the skip device 190 to move from beneath the fifth transportation slab 17 toward the sixth transportation slab 19 and lap thereon.

The following is a description of the operation of unclosing and enclosing the flaps of a carton.

FIG. 1*a* to FIG. 1*g* are perspective views showing the consecutive steps of unclosing and enclosing the flaps of cartons.

As shown in FIG. 1*a*, the empty carton 1 is disposed on the conveyers 4 so as to be transported in the direction of the arrow F shown in FIG. 1*a*. The opening of the carton 1 is disposed downward, and thus dust flaps 2 connecting to the side panels 20 and tuck flaps 3 connecting to side panels 30 are respectively extending substantially downward.

As shown in FIG. 1*b*, when the carton 1 is transported to the end portions 40 of the conveyer belts 4, the leading tuck flap 3 is raised, in the direction 5A, to a horizontal plane so as to lap on the first transportation slab 6 by flap unclose device 5 (shown in FIG. 2). At the same time, the guide device 7 (shown in FIG. 2) begins to guide the carton 1 to move along the transportation path.

As shown in FIG. 1*c*, when the carton 1 is guided to move forward, the lagging tuck flap 3 will eventually be urged by flap unclose device 5 to lap on the transportation slab 6. Under this circumstance, dust flaps 2 still remain extending downward.

As shown in FIG. 1*d*, when the carton 1 is guided to a place where the rear end edges 21 of the dust flaps 2 have just passed over the end portion 60 of the first transportation slab 6, the carton 1 is temporarily stopped, then piled articles 11 are stowed into the carton 1 from underneath the carton by means of the stow device 9 (shown in FIG. 4) which is disposed between the first transportation slab 6 and the second transportation slab 8. The guide frame 90 is provided to the stow device 9, so that the carton 1 can be pushed downward and be secured thereon by a push pad 91 (see FIG. 4) disposed above the carton 1. Thus, the carton 1 will be held fixedly during the stowing of the piled articles 11. After piled articles 11 have been stowed by the stow device 9, the stow plate 92 remains at the elevated position and the carton 1 is guided to move forward in the direction of the arrow F.

As shown in FIG. 1*e*, when the rear end edges 21 of the dust flaps 2 have just passed over the front end portion of the stow device 9, the dust flaps 2 will be folded along the direction 12A by flap enclose device 12 (shown in FIG. 2). Under this circumstance, the second transportation slab 8 will be trapped between the opening of the carton 1 and the dust flaps 2, then the carton 1 will be urged to move forward, and the dust flaps 2 will eventually be guided by the skip device 13 to move from beneath the second transportation slab 8 toward the third transportation slab 14 and lap thereon.

As shown in FIG. 1*f*, when the carton 1 is guided to a place where the leading end edge of the leading tuck flap 3 approaches the front end portion 140 of the third transportation slab 14, the leading tuck flap 3 will be folded backward by the leading flap enclose device 15 (shown in FIG. 2), and the carton 1 will be guided toward the fourth transportation slab 16. The end edge 150 of the leading flap enclose device 15 is raised to allow the leading end edge of the leading tuck flap 3 to insert into the space formed underneath the end edge 150, then the end edge 150 of the leading flap enclose device 15 is lowered to flush with the fourth transportation slab 16. Thus, the leading tuck flap 3 will be folded by the leading flap enclose device 15 when the carton 1 is urged to move forward.

Figure 1G:
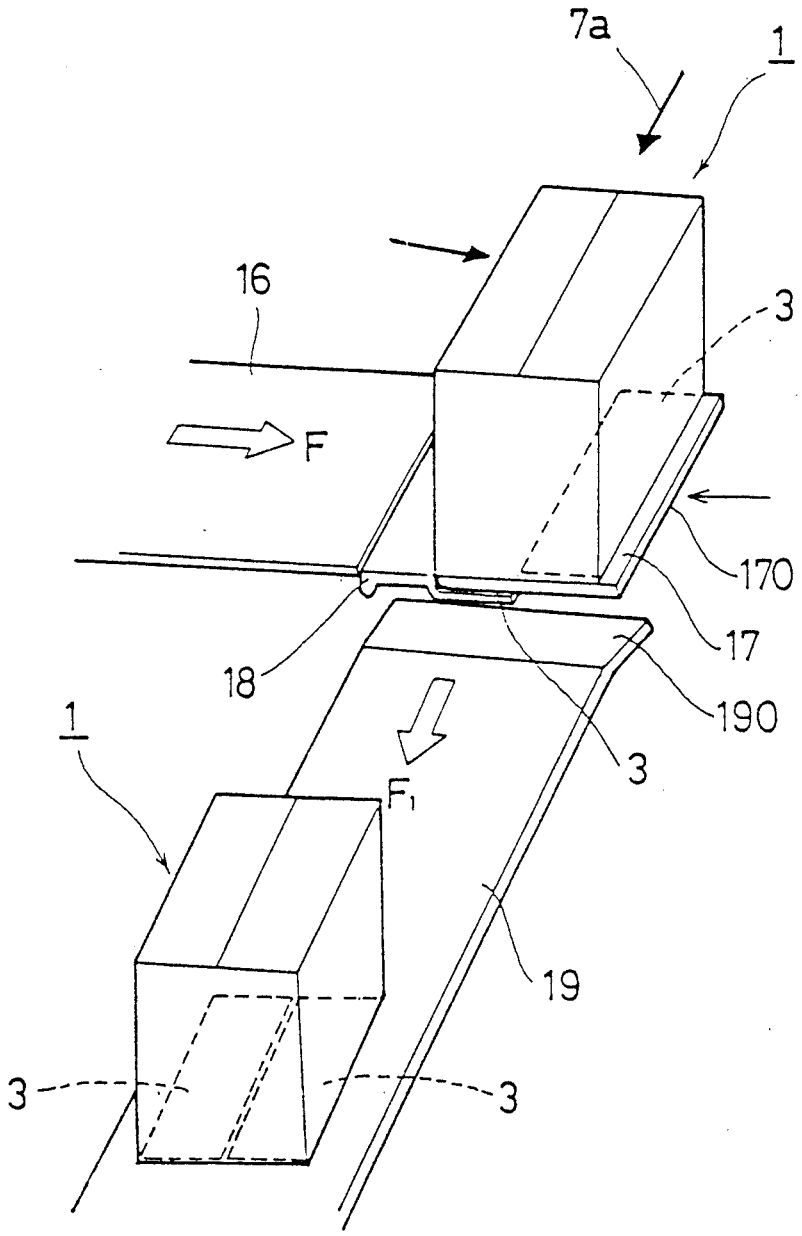

As shown in FIG. 1*g*, when the carton 1 is guided to approach the end portion 170 of the fifth transportation slab 17, the lagging tuck flap 3 will be folded forward by the lagging tuck flap enclose device 18 (shown in FIG. 2) which is disposed between the fourth transportation slab 16 and the fifth transportation slab 17. Under this circumstance, the fifth transportation slab 17 will be trapped between the opening of the carton 1 and the lagging tuck flap 3. During the folding of the lagging tuck flap 3, the carton 1 is stopped by a stopper 180 of the lagging tuck flap enclose device 18 (see FIG. 2) so that the carton 1 is kept from dropping down and the lagging tuck flap enclose device 18 can fold the tuck flap 3 in a proper way. After this, the fold plate 182 (see FIG. 2) of the lagging tuck flap enclose device 18 is lowered and the hook 186 (see FIG. 2) is actuated to urge the lagging tuck flap 3 toward the bottom of the fifth transportation slab 17, then the fold plate 182 is raised again to urge the lagging tuck flap 3 onto the bottom of the fifth transportation slab 17. After the lagging tuck flap 3 has been folded, the carton 1 is pushed by the push pad 188 (see FIG. 2) in the direction F1, thus the carton 1 will be urged to move in the direction F1, and the lagging tuck flap 3 will eventually be guided by the skip device 190 to move from beneath the fifth transportation slab 17 toward the sixth transportation slab 19 and lap thereon. Thus, all of the flaps of the carton 1 are enclosed and the articles 11 are packed in a swift way.

Figure 6:
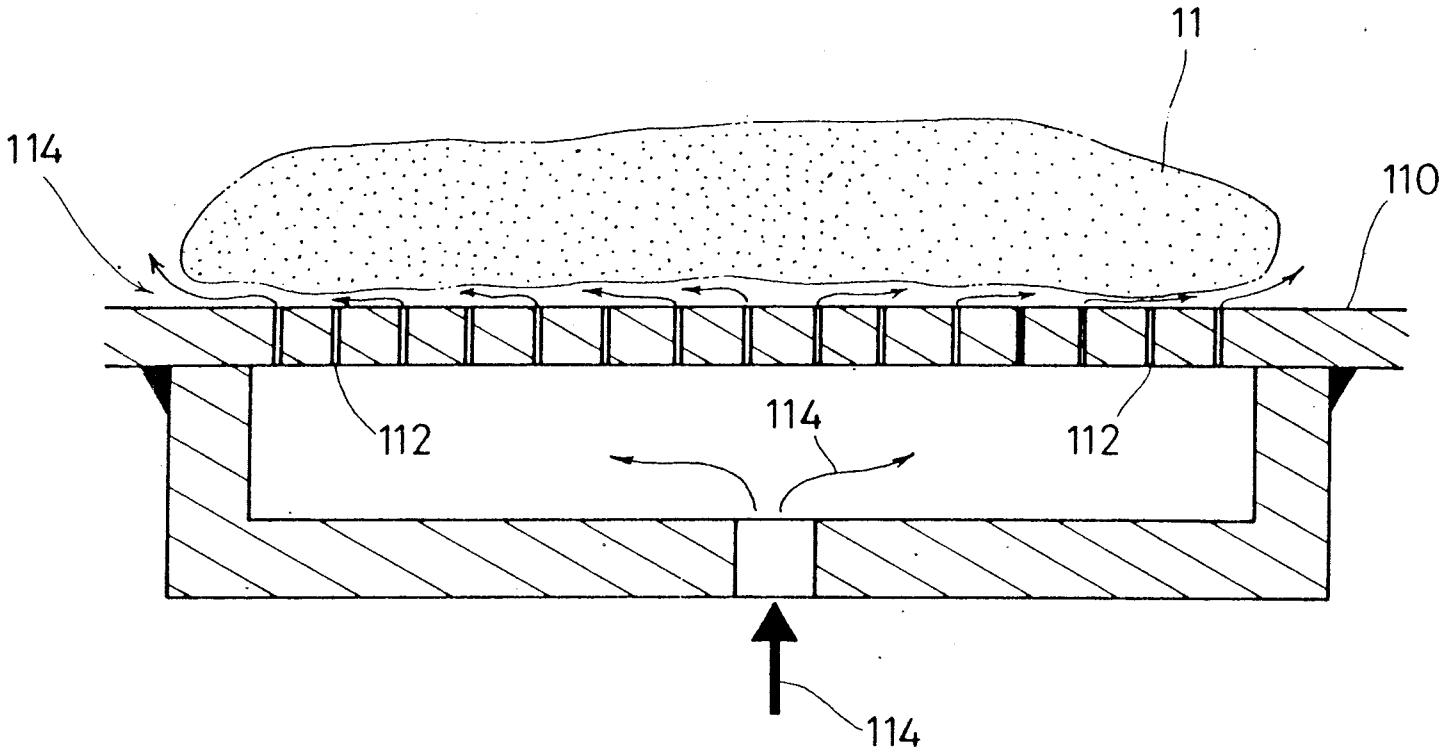
FIG. 6 is a cross-sectional view showing the construction of an air cushion conveyer which can be used in this invention.

Furthermore, FIG. 6 is a cross-sectional view showing the construction of an air cushion conveyer which can be used in this invention. Materials packed in bag 11 are being transported on a transportation surface 110 which is provided with a plurality of small through-holes 112 for sending the air therethrough to form an air film between the bag 11 and the transportation surface 110. By this, the bags 11 being transported will not be damaged, and the frictional forces induced will be reduced. Such an air cushion conveyer can be provided to the article standby plate a11, the shift plates a12, the stow plate 92, the fifth transportation slab 17, and so on.

As described above, the flaps of the carton can be unclosed and enclosed swiftly and consecutively without any cessations during an automatic packing process.

While the invention has been described in terms of what is presently considered to be the most practical and preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A method for unclosing and enclosing flaps of a package carton during an automatic packing process, the package carton is provided with one pair of first flaps and one pair of second flaps disposed generally perpendicular to each other and connected to an opening of the package carton, which method comprises:

(a) disposing an empty package carton on a first transportation device in such a way that the opening of the package carton faces downward and the two pairs of flaps extend downward without restraint from the opening of the carton, and a pair of second flaps being generally parallel with a longitudinal direction of the first transportation device;

(b) guiding the package carton to move continuously in the longitudinal direction of the first transportation device;

(c) folding a leading first flap in an upward and forward direction, and guiding the leading first flap to lap on a first transportation slab disposed adjacent to an end portion of the first transportation device, then urging a lagging first flap to lap on the first transportation slab, so as to let the second pair of flaps extend downward without any restraints during the movement of the package carton, the first transportation slab having a longitudinal axis;

(d) stowing at least one article in the package carton;

(e) moving the package carton with the at least one article to a second transportation slab;

(f) folding the second pair of flaps to trap a second transportation slab disposed downstream of an end of the first transportation slab between the opening of the package carton and the second pair of flaps during the movement of the package carton;

(g) moving the carton from the second transportation slab to a third transportation slab and guiding the second pair of flaps to skip from underneath the second transportation slab and to lap on the third transportation slab disposed adjacent to the end portion of the second transportation slab during the movement of the package carton;

(h) moving the carton from the third transportation slab to a fourth transportation slab and folding the leading first flap in a downward and backward direction to trap the third transportation slab between the opening of the package carton and the leading first flap, and guiding the leading first flap to lap on the fourth transportation slab closely spaced from the end portion of the third transportation slab during the movement of the package carton, the package carton being moved from the third transportation slab to the fourth transportation slab and the leading first flap being guided to lap on the fourth transportation slab in a direction which is generally parallel to the longitudinal axis of the first transportation slab;

(i) folding the lagging first flap in a downward and forward direction to trap a fifth transportation slab between the opening of the package carton and the lagging first flap; and (j) moving the package carton from the fifth transportation slab to a sixth transportation slab and guding in a direction generally perpendicular to a longitudinal direction of the fifth transportation slab, the lagging first flap to lap on the sixth transportation slab disposed adjacent to the fifth transportation slab during the movement of the package carton.

2. The method for unclosing and enclosing flaps of a package carton as recited in claim 1, wherein the longitudinal direction of the first transportation device and the longitudinal axis of the first transport slab are generally parallel such that the carton is moved in generally a same direction from the first transportation device to the first transportation slab.

3. The method for unclosing and enclosing flaps of a package carton as recited in claim 2, wherein the second, third, fourth and fifth transportation slabs each have longitudinal axes which are generally parallel to the longitudinal axis of the first transportation slab and the carton is moved in generally the same direction along the longitudinal axes from the first to the second, the third, the fourth and then the fifth transportation slab.

4. The method for unclosing and enclosing flaps of a package carton as recited in claim 1, wherein the step (c) of folding further comprises the steps of temporarily stopping movement of the carton in the longitudinal direction of the first transportation device before folding the leading first flap and then continuing movement of the carton in the longitudinal direction by a second transportation device, movement of the carton onto the first transportation slab by the second transportation device causing the urging of the lagging first flap to lap on the first transportation slab.

5. The method for unclosing and enclosing flaps of a package carton as recited in claim 4, wherein the folding of the leading first flap includes the step of raising plates from beneath the first transportation device to a position close to the first transportation slab in order to fold the leading first flap in the upward and forward direction.

6. The method for unclosing and enclosing flaps of a package carton as recited in claim 1, wherein the step (d) of stowing further comprises the steps of moving the empty package carton above a stow device and inserting the at least one article into the opening in the bottom of the container.

7. The method for unclosing and enclosing flaps of a package carton as recited in claim 6, further comprising the steps of lowering the carton onto the stow device before the step of inserting, raising the at least one article into the carton during the step of inserting and disengaging the carton from the stow device by raising the carton therefrom after the step of inserting.

8. The method for unclosing and enclosing flaps of a package carton as recited in claim 1, wherein the step (h) of moving and folding further comprises the step of raising an edge of a leading flap enclose device to insert the leading first flap below the leading flap enclose device as the carton moves from the third transportation slab to the fourth transportation slab and thereafter lowering the edge of the leading flap enclose device to be generally flush with the fourth transportation slab whereby the leading first flap is folded beneath the carton when the carton moves onto the fourth transportation slab.

9. The method for unclosing and enclosing flaps of a package carton as recited in claim 1, wherein the step (i) of folding further comprises stopping movement of the carton in the direction generally parallel to the longitudinal axis of the first transportation slab, pivoting a lagging tuck flap enclose device downwardly whereby downward movement of the lagging first flap is unobstructed, moving the lagging first flap downwardly with a hook and pivoting the lagging tuck flap enclose device upwardly to move the lagging first flap beneath the fifth transportation slab.

10. The method for unclosing and enclosing flaps of a package carton as recited in claim 1, further comprising the step of transporting the at least one article on an air cushion before the at least one article is completely enclosed in the carton.

11. An apparatus for unclosing and enclosing flaps of a package carton during an automatic packing process, the package carton is provided with one pair of first flaps and one pair of second flaps disposed generally perpendicular to each other and connected to an opening of the package carton, which apparatus comprises:

first transportation means for receiving an empty carton with the opening of the package carton facing downwardly and the two pairs of flaps extending downwardly without restraint from the opening of the carton, and a pair of second flaps being generally parallel with a longitudinal direction of the first transportation means;

means for guiding the package carton to move continuously in the longitudinal direction of the first transportation means;

means for folding a leading first flap in an upward and forward direction, and guiding the leading first flap to lap on a first transportation slab disposed adjacent to an end portion of the first transportation means, then urging a lagging first flap to lap on the first transportation slab, so as to let the second pair of flaps extend downward without any restraints during the movement of the package carton, the first transportation slab having a longitudinal axis;

stowing means for inserting at least one article into the package carton;

means for folding the second pair of flaps to trap a second transportation slab disposed downstream of an end of the first transportation slab between the opening of the package carton and the second pair of flaps during the movement of the package carton;

means for guiding the second pair of flaps to skip from underneath the second transportation slab and to lap on a third transportation slab disposed adjacent to the end portion of the second transportation slab during the movement of the package carton;

folder means for folding the leading first flap in a downward and backward direction to trap the third transportation slab between the opening of the package carton and the leading first flap, and guiding the leading first flap to lap on a fourth transportation slab closely spaced from the end portion of the third transportation slab during the movement of the package carton;

means for folding the lagging first flap in a downward and forward direction to trap a fifth transportation slab between the opening of the package carton and the lagging first flap;

second transportation means for moving the carton at least from the means for guiding the second pair of flaps to the folder means for folding the leading first flap and then to the means for folding the lagging first flap, the second transportation means moving the carton in a generally linear direction; and means for guiding, in a direction generally perpendicular to a longitudinal direction of the fifth transportation slab, the lagging first flap to lap on a sixth transportation slab disposed adjacent to the fifth transportation slab during the movement of the package carton.

12. The apparatus for unclosing and enclosing flaps of a package carton as recited in claim 11, wherein the generally linear direction of the second transportation means and the longitudinal direction of the first transportation means are generally parallel such that the carton is moved in the same direction from the first transportation means to the first transportation slab and from the means for guiding the second pair of flaps to the folder means for folding the leading first flap and to the means for folding the lagging first flap.

13. The apparatus for unclosing and enclosing flaps of a package carton as recited in claim 12, wherein the first, second, third, fourth and fifth transportation slabs each have a longitudinal axis which are generally coincident with one another and wherein the generally linear direction of the second transportation means is generally parallel to the axes of the first, second, third, fourth and fifth transportation slabs whereby the second transportation means moves the carton in a single, generally linear direction.

14. The apparatus for unclosing and enclosing flaps of a package carton as recited in claim 11, wherein the means for folding the leading first flap in an upward and forward direction further comprises stoppers for temporarily stopping movement of the carton, plates for holding the carton in position over the first transportation means, and tuck flap enclose plates for raising the leading first flap to be aligned with the first transportation slab.

15. The apparatus for unclosing and enclosing the flaps of a package carton as recited in claim 14, wherein the tuck flap enclose plates are raised from a position beneath the first transportation means to a position close to the first transportation slab in order to fold the leading first flap in the upward and forward direction.

16. The apparatus for unclosing and enclosing the flaps of a package carton as recited in claim 11, wherein the stowing means further comprises an elevatable stow plate for receiving the at least one article and means for raising the stow plate and the at least one article to move the at least one article through the opening in the bottom of the container.

17. The apparatus for unclosing and enclosing the flaps of a package carton as recited in claim 16, wherein the stowing means further comprises a push pad for engaging a top of the carton, a guide frame for guiding the at least one article on the stow plate into the carton, means for lowering the push pad onto the top of the carton to push the carton onto the guide frame and means for raising the carton from the guide frame to disengage the carton from the guide frame.

18. The apparatus for unclosing and enclosing the flaps of a package carton as recited in claim 11, wherein the folder means for folding the leading first flap in a downward and backward direction further comprises a leading flap enclose device having a pivotable edge, the edge being raised to insert the leading first flap below the leading flap enclose device as the second transportation means moves the carton from the third trasnportation slab to the fourth transportation slab and thereafter the edge is lowered to be generally flush with the fourth transportation slab whereby the leading first flap is folded beneath the carton when the carton is moved by the second transportation means onto the fourth transportation slab.

19. The apparatus for unclosing and enclosing the flaps of a package carton as recited in claim 11, wherein the means for folding the lagging first flap further comprises a stopper for stopping movement of the carton in the generally linear direction, a pivotable lagging flap fold plate and a hook, the flap fold plate being lowerable from a first to a second position to enable unobstructed downward movement of the lagging first flap, the hook thereafter being moved to lower the lagging first flap whereafter the flap fold plate is raised from the second to the first position to thereby move the lagging first flap beneath the fifth transportation slab.

20. The apparatus for unclosing and enclosing the flaps of a package carton as recited in claim 11, further comprising an air cushion conveyor for transporting the at least one article on an air cushion before the at least one article is completely enclosed in the carton.

* * * * *